United States Patent [19]

Gallaher, Jr.

[11] 4,157,757

[45] Jun. 12, 1979

[54] COMPOSITE COVER-SUPPORT FOR ELECTRONIC EQUIPMENT AND INSTRUCTIONAL MATERIALS

[76] Inventor: John K. Gallaher, Jr., P.O. Box 10767, Salem Station, Winston-Salem, N.C. 27108

[21] Appl. No.: 870,943

[22] Filed: Jan. 20, 1978

[51] Int. Cl.[2] ..... B65D 85/38

[52] U.S. Cl. ..... 206/328; 206/472

[58] Field of Search ..... 206/328, 329, 425, 465, 206/472, 473, 232, 44 B, 803; 229/1.5; 402/4, 80

[56] References Cited

U.S. PATENT DOCUMENTS

| | | | |
|---|---|---|---|
| 2,223,560 | 12/1940 | Friedlaender | 402/4 |
| 2,239,145 | 4/1941 | Doner | 206/232 |
| 3,352,415 | 11/1967 | Seeley et al. | 206/465 |

*Primary Examiner*—William T. Dixson, Jr.

[57] ABSTRACT

A composite loose leaf notebook and support structure for electronic components and instructional materials comprising a cover assembly having a pair of planar cover members, first and second planar support members for a structure particularly designed housing to receive electronic equipment such as microcomputers and the like, and means of retaining the structure and instructional materials within the planar cover members, these elements being arranged in such a manner that, when the planar cover members are folded upon themselves, the electronic components and instructional materials lie adjacent each other, occupy substantially the total space between the cover members, and are coplanar, the electronic components being held in functional position between the planar cover members by said pair of substantially parallel and spaced apart planar support members.

2 Claims, 4 Drawing Figures

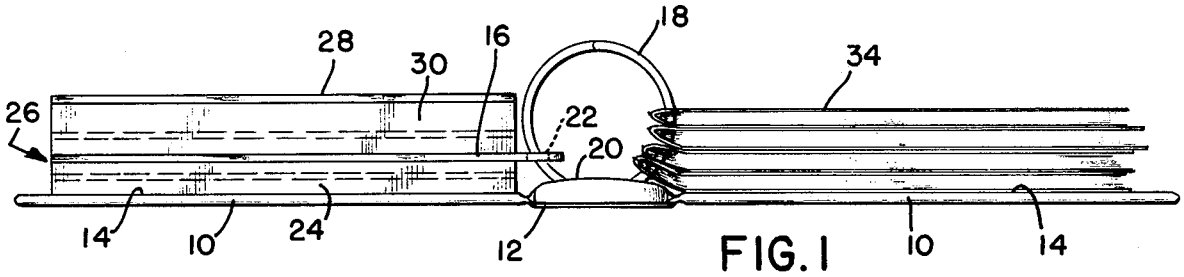
FIG. 1
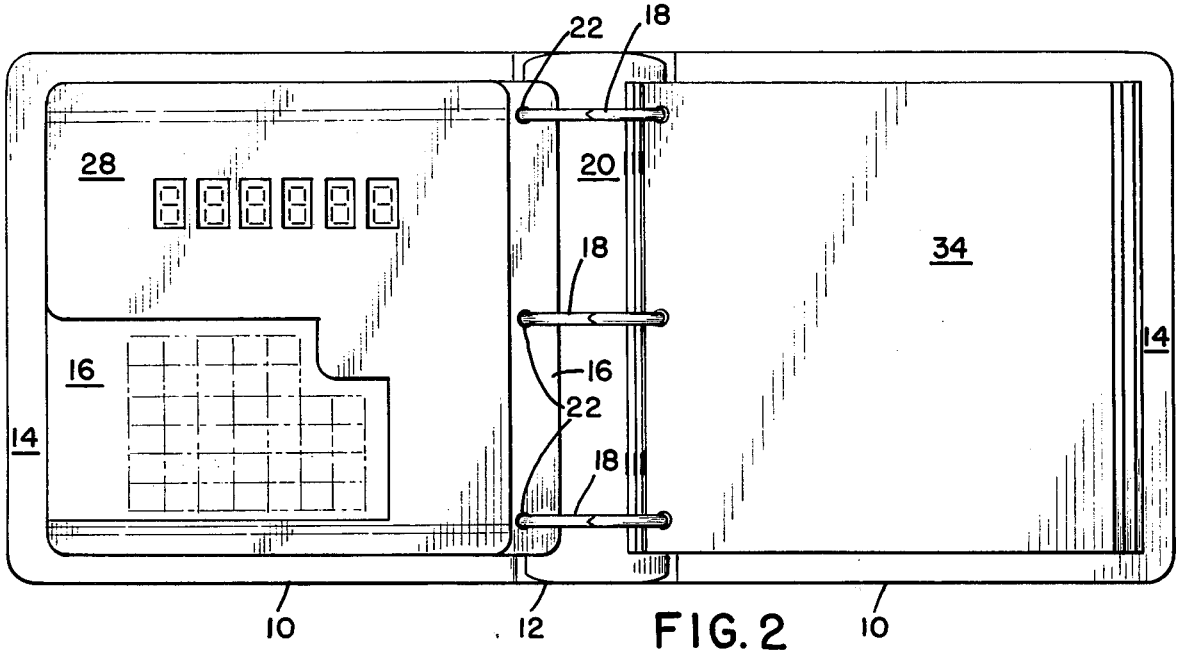
FIG. 2
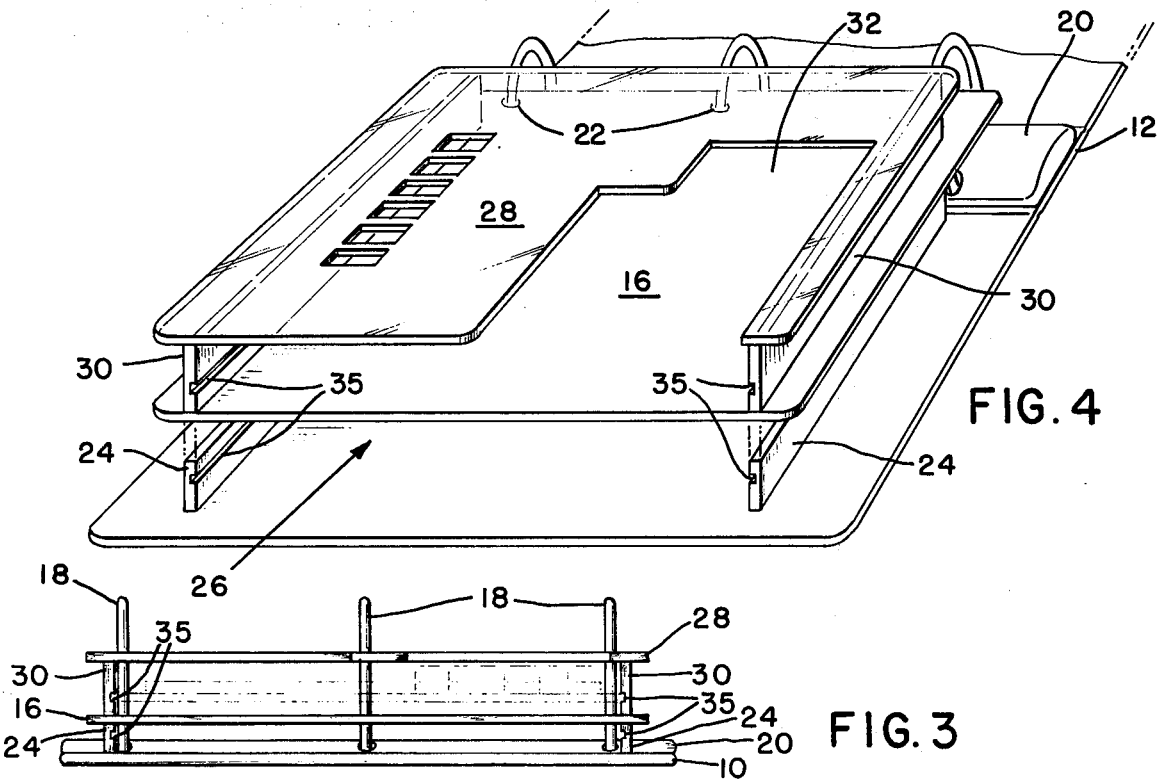
FIG. 4
FIG. 3

COMPOSITE COVER-SUPPORT FOR ELECTRONIC EQUIPMENT AND INSTRUCTIONAL MATERIALS

BACKGROUND, BRIEF SUMMARY AND OBJECTS OF THE INVENTION

This invention concerns a composite loose leaf notebook and support structure for electronic components and instructional materials generally in the form of a book. By electronic components is meant any relatively rigid package such as, for example, an instructional microcomputer system kit, and by instructional materials is meant general explanatory directions, operation manuals, codes and the like for use in operating such systems. The present invention provides a protective environment and a unique housing for such equipment and instructional materials associated therewith in one book form.

A primary objective of the present invention is to provide a portable enclosure uniquely suited for using and displaying electronic equipment and its associated instructional materials.

Another object of the present invention is to provide a combination book and support structure for housing functional electronic equipment and associated materials not heretofore available.

Yet another object of the present invention is to provide a composite loose leaf notebook and support structure of a new form suitable for shelving and subsequent identification in accordance with library standards.

To achieve these objectives, the composite book and support structure embracing the present invention includes planar cover members similar to a book cover, and associated with these cover members support members for carrying one or more components of electronic equipment. The support members and the instructional materials such as pamphlets, manuals, and books are disposed in such a mutual relationship that, when the planar cover members are folded together, they are juxtaposed, the whole presenting a compact, functional and convenient form for housing, protecting and using the electronic components and instructional materials.

The supporting members for the electronic components and the instructional materials are essentially variable, and it is necessary only that they permit accessibility to said components and optionally to the books or pamphlets so that these may conveniently and rapidly be withdrawn from and replaced in the assembly when the planar cover members are in the open, unfolded position.

In a preferred embodiment, the support structure comprises first and second transparent support members movably positioned to cooperatively receive electronic components therebetween held within the planar cover members proximate a collection of books or pamphlets, the arrangement being such that access to the components with a view to extracting one or more of same is permitted only when the cover members are sufficiently opened.

These and other objectives of the present invention will become more apparent after consideration of the following detailed description taken in conjunction with the accompanying drawings wherein like characters of reference designate like parts throughout the several views.

BRIEF DESCRIPTION OF THE DRAWING

FIG. 1 is an end elevational view of the combination book and support structure comprising the present invention showing the structure for the electronic components lying adjacent to one of the planar cover members and the instructional materials lying adjacent the second planar member.

FIG. 2 is a plan view of the preferred embodiment of the present invention illustrated in FIG. 1;

FIG. 3 is a side elevational view of the preferred embodiment of the present invention illustrated in FIGS. 1 and 2;

FIG. 4 is a fragmentary, perspective and exploded view of a portion of the preferred embodiment of the present invention particularly illustrating the support structure for forming a protective environment for one or more components of electronic equipment.

DETAILED DESCRIPTION OF THE INVENTION

Referring now to the drawings and particularly to FIG. 2, there is illustrated a plan view of the cover assembly embodying the present inventive concept having a pair of planar cover members 10 joined together along a mutual fold hinge area 12, the planar cover members having inner surfaces 14 positioned for supporting other components that will be described subsequently. A first support member 16 lies generally parallel to but relatively movable with at least one of the planar cover members as shown in FIGS. 1 and 3. Arcuately-shaped binder rings 18 are movably held by a ring support member 20. The first support member 16 is movably affixed to rings 18 by apertures 22 provided in the support member at the needed locations.

A pair of depending first support member legs 24 are vertically secured to said first support member to maintain that member a fixed distance away from and adjacent to one of the planar cover members 10. The positioning of these legs 24 with respect to the first support member 16 and the inner surface 14 of one of the planar cover members 10 forms a compartment shown generally as 26 to house one or more electronic components maximizing convenience, maintenance and functionality within a confined space.

A second support member 28 is positioned substantially parallel to and adjacent with said first support member 16 in a manner best shown in FIG. 3. A second pair of depending legs 30 supports the second support member 28, the legs being of a height to support the second support member 28 a distance from the first support member 16 that is different from the distance maintained by legs 24 between the first support member 16 and the inner surface 14 of one of the planar cover members 10. The first and second support members 16 and 28 may be fixedly positioned each with respect to the other and movable together relative to the planar cover members 10 if depending legs 24 and 30 are securely bonded to each support member. The depending legs 30, second support member 28 and the upper surface of first support member 16 then form a second compartment for housing one or more electronic components that are interconnected by appropriate conductors to the components of the first support member forming a part of the entire kit or assembly.

It has been found advantageous in some uses, for example in constructing a protective environment for the Motorola MEK6800D-2 Microcomputer Kit, to design the second support member 28 so as to form a relatively large recess 32 enabling the display of one or more character or function keys such as shown in dotted lines in FIG. 2 to enable ready access to the component. The second support member is made of transpatent material to allow reading of visual information displayed by the kit. Obviously, the configuration of the recess is unlimited and will be formed to most beneficially expose the internal components to which access is needed.

It has also been found advantageous to provide a plurality of recesses 35 in the depending legs 24 and 30 to cooperatively receive panels (not shown) carrying fixedly positioned components and the like.

The cover assembly includes space between the planar cover members 10 for storing instructional materials 34 such as shown in FIGS. 1 and 2. These materials may be perforated and secured within the assembly by the binder rings 22 in a convenient and conventional manner.

The present invention contemplates space within the unique structure for housing a complete and detachable power supply that will allow the microcomputer or other carried electronic system to be operated in the binder for a comfortable period of time. Conventional systems of this nature utilize a remote power supply and require at least a partial disassociation of the carried electronic components from the associated cover assembly.

Although a preferred embodiment of this invention has been shown and described for the purpose of illustration, as required by Title 35 U.S.C. 112, it is to be understood that various changes and modifications may be made therein without departing from the spirit and utility of the invention or the scope thereof, as set forth in the appended claims.

I claim:

1. A loose-leaf ring notebook and support structure for functionally housing electronic components and instructional materials comprising: at least a pair of planar cover members joined together along a mutual fold hinge area and having inner surfaces; a first substantially flat support member proximate one of said planar cover members and movable with respect thereto; means supporting said first support member a fixed difference away from and substantially parallel to said one of said planar cover members; means hingedly and releasably retaining said first support member to said pair of planar cover members proximate said mutual fold hinge area; a second support member substantially parallel and adjacent to said first support member; means supporting said second member a fixed distance away from and substantially parallel to one of said planar cover members, said first and second members fixedly positioned each with respect to the other and movable relative to said planar cover members to cooperatively and functionally receive electronic components therebetween, said movably and releasably retaining means releasably securing instructional materials proximate said first and second support members and between said planar cover members, said electronic components being operably and releasably secured to said first and second member supporting means and including a microcomputer system, and said second support member recess enabling access to a computer keyboard.

2. The combination as claimed in claim 1 wherein said first and second support member are transparent and slidably receive the electronic components adjacent thereto and therebetween.

* * * * *